US010151286B2

(12) United States Patent
Suzuki

(10) Patent No.: US 10,151,286 B2
(45) Date of Patent: Dec. 11, 2018

(54) CLIP FOR FUEL INJECTION VALVE AND FUEL INJECTION VALVE UNIT

(71) Applicant: DENSO CORPORATION, Kariya, Aichi-pref. (JP)

(72) Inventor: Hiromu Suzuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 135 days.

(21) Appl. No.: 15/506,057

(22) PCT Filed: Mar. 2, 2016

(86) PCT No.: PCT/JP2016/001115
§ 371 (c)(1),
(2) Date: Feb. 23, 2017

(87) PCT Pub. No.: WO2016/152038
PCT Pub. Date: Sep. 29, 2016

(65) Prior Publication Data

US 2018/0223781 A1 Aug. 9, 2018

(30) Foreign Application Priority Data

Mar. 23, 2015 (JP) ..... 2015-059638

(51) Int. Cl.
*F02M 55/02* (2006.01)
*F02M 61/14* (2006.01)
*F02M 61/16* (2006.01)

(52) U.S. Cl.
CPC ..... *F02M 55/02* (2013.01); *F02M 61/14* (2013.01); *F02M 61/16* (2013.01); *F02M 2200/8023* (2013.01); *F02M 2200/856* (2013.01)

(58) Field of Classification Search
CPC ..... F02M 61/14; F02M 61/16; F02M 55/004; F02M 55/025; F02M 55/02;
(Continued)

(56) References Cited

U.S. PATENT DOCUMENTS 7,802,559 B2 * 9/2010 Furst ..... F02M 61/14 123/470
8,707,930 B2 * 4/2014 Bolz ..... F02M 55/004 123/470
(Continued)

FOREIGN PATENT DOCUMENTS

JP 5126083 1/2013

OTHER PUBLICATIONS

Matsukawa et al., "Fuel Injection Apparatus", Japan Institute of Invention and Innovation, Journal of Technical Disclosure, No. 2014-500735, Mar. 3, 2014, 7 pages.
(Continued)

*Primary Examiner* — Sizo Vilakazi
(74) *Attorney, Agent, or Firm* — Nixon & Vanderhye P.C.

(57) ABSTRACT

A clip—for a fuel injection valve includes a load transmitting member—and a fitting member. The load transmitting member is formed from a single wire material and includes a contacting portion, which contacts a contactable surface formed in the fuel injection valve, a depressible portion, which is depressible in a downward direction by a pressing surface formed in a fuel supply conduit, and a spring portion, which is formed between one end of the contacting portion and the depressible portion and is resiliently deformable by a load. The fitting member-is formed separately from the load transmitting member and is connected to the load transmitting member on a side of the contacting portion, which is opposite from the spring portion. The fitting member is fittable to a fittable portion of the fuel supply conduit.

6 Claims, 15 Drawing Sheets

(58) Field of Classification Search
CPC ..... F02M 2200/8023; F02M 2200/853; F02M 2200/856; F02M 2200/9053
See application file for complete search history.

(56) References Cited

U.S. PATENT DOCUMENTS

| | | | | |
|---|---|---|---|---|
| 9,874,187 | B2 * | 1/2018 | Kurt | F02M 55/025 |
| 9,938,948 | B2 * | 4/2018 | Serra | F02M 61/14 |
| 2009/0056674 | A1 * | 3/2009 | Furst | F02M 61/14<br>123/470 |
| 2017/0356413 | A1 * | 12/2017 | Oh | F02M 61/14 |

OTHER PUBLICATIONS

U.S. Appl. No. 15/538,316 of Suzuki, filed Jun. 21, 2017, entitled Clip for Fuel Injection Valve and Fuel Injection Valve Unit, (40 pages).

* cited by examiner

CLIP FOR FUEL INJECTION VALVE AND FUEL INJECTION VALVE UNIT

CROSS REFERENCE TO RELATED APPLICATION

This application is the U.S. national phase of International Application No. PCT/JP2016/001115 filed on Mar. 2, 2016, which designated the U.S. and claims priority to Japanese Patent Application No. 2015-59638 filed on Mar. 23, 2015, the entire contents of each of which are hereby incorporated by reference.

TECHNICAL FIELD

The present disclosure relates to a clip, which is installed to a fuel injection valve of a fuel injection apparatus, as well as a fuel injection valve unit, which includes the fuel injection valve and the clip.

BACKGROUND ART

Previously, there is known a support clamp provided in a fuel injection apparatus that injects fuel in an internal combustion engine. This support clamp urges and holds a fuel injection valve installed to the internal combustion engine. For example, the support clamp, which is disclosed in the patent literature 1 is formed by stamping a corresponding portion from a plate material and bending the stamped material into a predetermined shape.

However, since the support clamp of the patent literature 1 uses the plate material, a yield rate is relatively low. Furthermore, the configuration of the support clamp is complicated. Therefore, there is a possibility of increasing the processing and manufacturing costs. In order to address the above disadvantages, the non-patent literature 1 discloses a support clamp, which is formed integrally from a wire material.

In the present description, a member, which is the same type as that of the support clamp disclosed in the non-patent literature 1 will be referred to as a clip for a fuel injection valve. Furthermore, an engaging portion of the clip for the fuel injection valve disclosed in the non-patent literature 1 will be referred to as a contacting portion.

The clip for the fuel injection valve according to the non-patent literature 1 has revolution limiting portions that are fitted to a fittable portion of a fuel supply conduit to limit relative rotation between the fuel supply conduit and the fuel injection valve. Each of the revolution limiting portions is continuously and integrally formed with a corresponding spring portion and is connected to a corresponding contacting portion through the spring portion. Therefore, when portions (depressible portions) of the clip, which contact a connecting cup, are depressed, the spring portions will be resiliently deformed. Thereby, at this time, the revolution limiting portions may possibly be simultaneously displaced to cause detachment of the revolution limiting portions from the fittable portion of the fuel supply conduit.

CITATION LIST

Patent Literature

PATENT LITERATURE 1: JP5126083B2

Non-Patent Literature

NON-PATENT LITERATURE 1: JAPAN INSTITUTE OF INVENTION AND INNOVATION, JOURNAL OF TECHNICAL DISCLOSURE No. 2014-500735

SUMMARY OF INVENTION

The present disclosure addresses the above disadvantage, and it is an objective of the present disclosure to provide a clip for a fuel injection valve, capable of limiting disengagement of the clip from a fittable portion of a fuel supply conduit when a depressible portion of the clip is depressed. It is another objective of the present disclosure to provide a fuel injection valve unit, which includes the clip and the fuel injection valve.

The present disclosure relates to a clip for a fuel injection valve in a fuel injection apparatus that includes a fuel supply conduit and the fuel injection valve, while the fuel injection valve is connected to the fuel supply conduit and is operable to inject fuel received from the fuel supply conduit into an internal combustion engine through an injection hole, which is formed at a distal end of the fuel injection valve, and the clip for the fuel injection valve is installed to at least a part of an outer peripheral part of the fuel injection valve such that the clip is fitted to a fittable portion that is formed in the fuel supply conduit, and the clip for the fuel injection valve holds the fuel injection valve between the fuel supply conduit and the internal combustion engine. The clip for the fuel injection valve includes a load transmitting member and a fitting member.

An axis of the fuel injection valve is defined as an imaginary axis. A direction, which is parallel to the imaginary axis, is defined as a z-direction, while a direction, which is directed toward the fuel supply conduit in the z-direction, is defined as a plus z-direction, and a direction, which is directed toward the distal end of the fuel injection valve in the z-direction, is defined as a minus z-direction.

The load transmitting member is formed from a single wire material and includes at least one contacting portion and at least one spring portion. The load transmitting member is operable to transmit a load, which is received from the fuel supply conduit, to the fuel injection valve.

The at least one contacting portion contacts a contactable surface formed in the fuel injection valve. The at least one depressible portion is depressible in the minus z-direction by a pressing surface formed in the fuel supply conduit. The at least one spring portion is formed between one end of the at least one contacting portion and the at least one depressible portion and is resiliently deformable by a load, which is applied in the minus z-direction and is received by the at least one depressible portion, while the at least one spring portion transmits the load applied in the minus z-direction to the at least one contacting portion.

The fitting member is formed separately from the load transmitting member and is connected to the load transmitting member on an opposite side of the at least one contacting portion, which is opposite from the at least one spring portion. The fitting member is fittable to the fittable portion of the fuel supply conduit. The clip for the fuel injection valve according to the present disclosure is characterized in that the load transmitting member, which transmits the load from the fuel supply conduit to the fuel injection valve, is formed separately from the fitting member, which is fitted to the fittable portion of the fuel supply conduit and limits relative rotation between the fuel supply conduit and the fuel injection valve. Thereby, even when the depressible portion of the load transmitting member is depressed by the pressing surface to cause deformation of the spring portion, a stress generated therefrom is not easily transmitted to the fitting member. Therefore, it is possible to limit disengagement of the fitting member from the fittable portion of the fuel supply conduit.

DESCRIPTION OF EMBODIMENTS

Hereinafter, a clip for a fuel injection valve according to a plurality of embodiments of the present disclosure will be described with reference to the drawings. In the following embodiments, substantially the identical structures are indicated by the same name and the same reference sign, and description thereof is omitted.

First Embodiment

A clip for a fuel injection valve according to a first embodiment will be described with reference to FIGS. 1(*a*) to 9. First of all, an entire structure of a fuel injection apparatus 99, in which the clip for the fuel injection valve is applied, will be described with reference to FIGS. 7 and 8.

The fuel injection apparatus 99 includes a rail main body 70, connecting pipes 801 and fuel injection valves 60.

Figure 7:
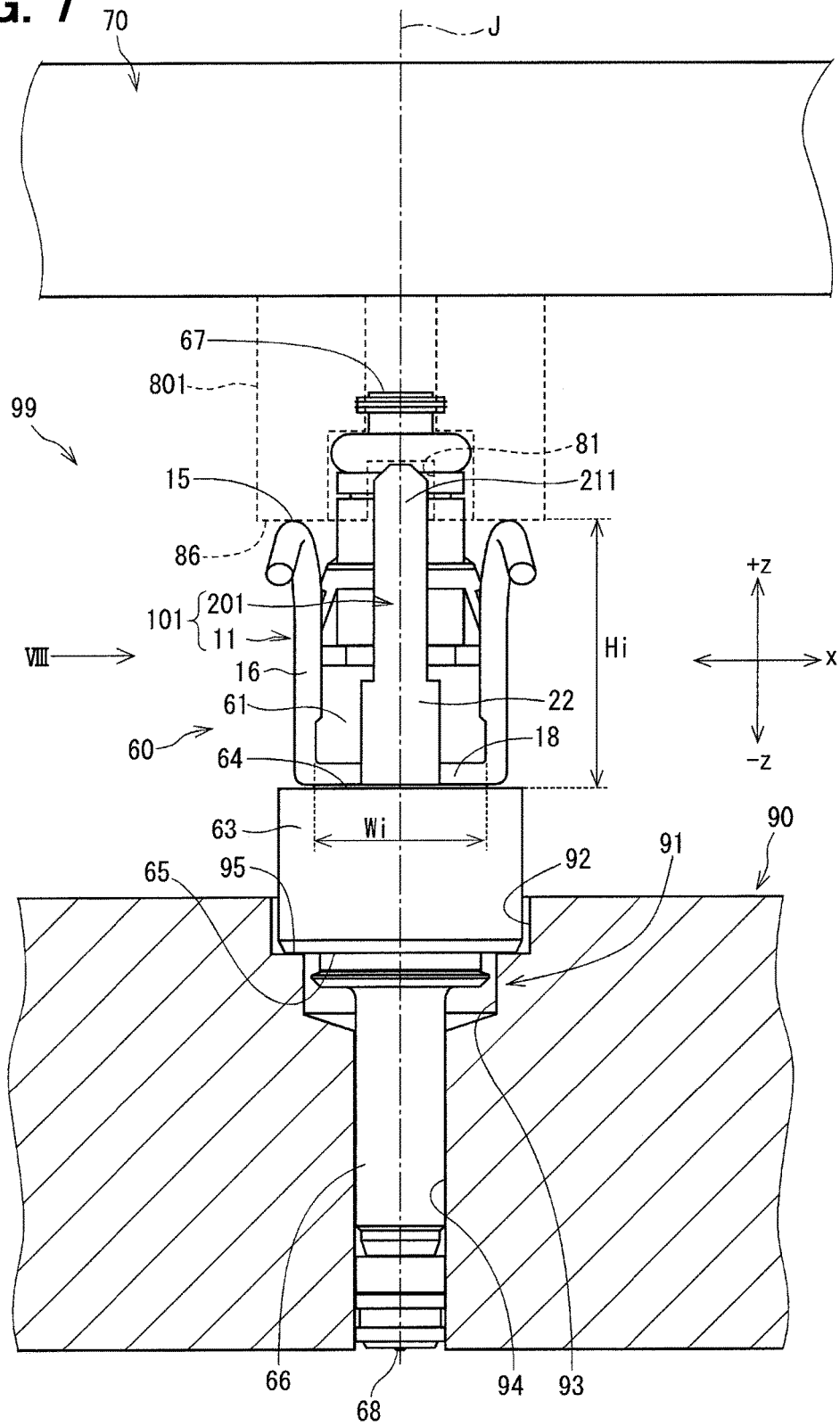
FIG. 7 is a diagram indicating a state where the fuel injection valve, to which the clip for the fuel injection valve according to the first embodiment of the present disclosure is installed, is installed to an engine.
Figure 8:
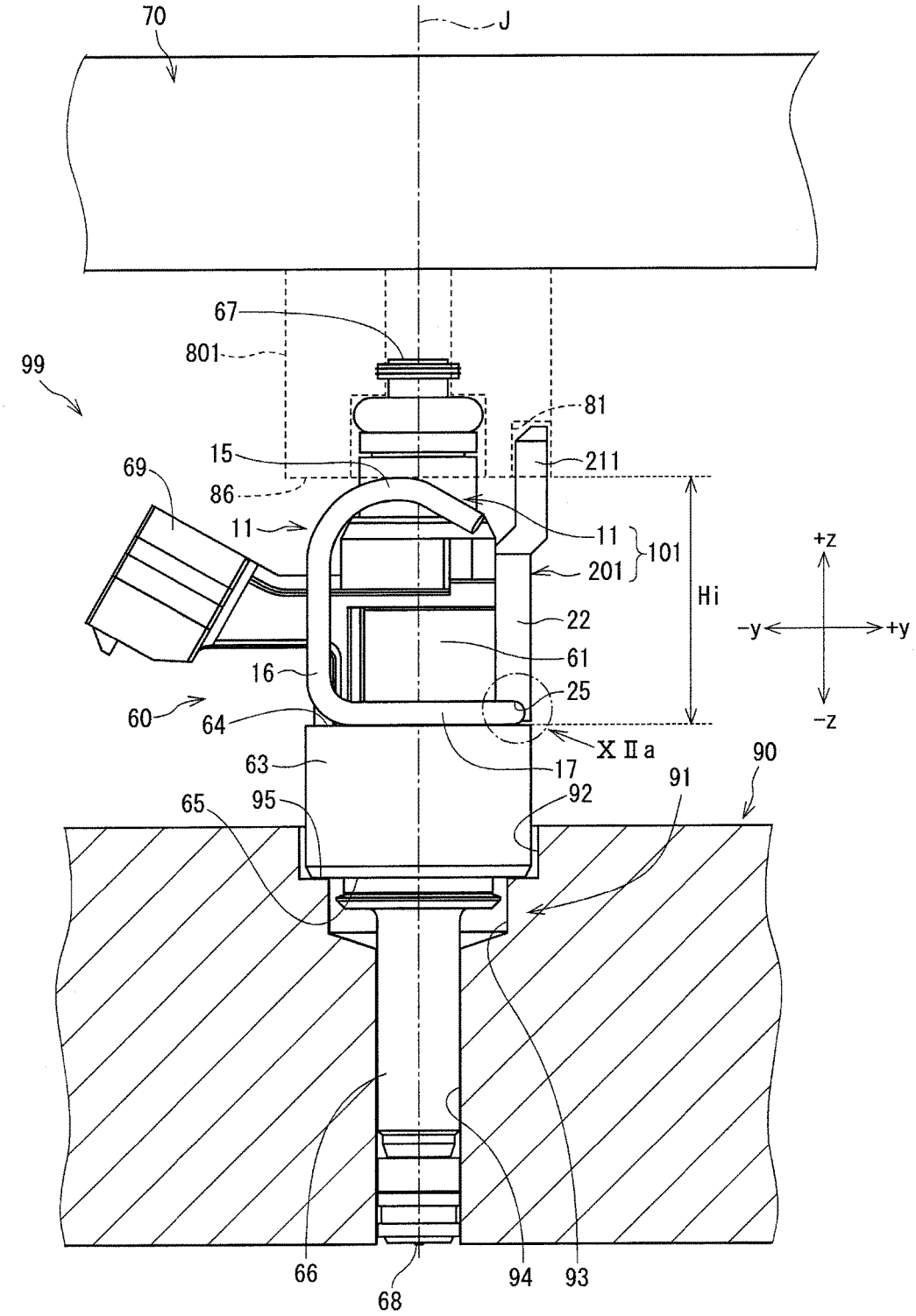
FIG. 8 is a side view taken in a direction of an arrow VIII in FIG. 7.

The rail main body 70 and the connecting pipes 801 constitute "a fuel supply conduit" of claims. The rail main body 70, which is shaped into a block form, distributes high pressure fuel, which is supplied from a high pressure pump (not shown), to a plurality of passages depending on the number of cylinders of an internal combustion engine (hereinafter referred to as an engine) 90. FIGS. 7 and 8 show only one of these passages. Each connecting pipe 801 projects from a bottom surface of the rail main body 70 toward the engine 90 and is also referred to as "a connecting cup."

Each fuel injection valve 60 is installed at a location between the rail main body 70 and the engine 90. Specifically, a fuel inlet 67 side of the fuel injection valve 60 is connected to the corresponding connecting pipe 801, and a distal end side of the fuel injection valve 60, which has an injection hole 68, is inserted into an installation hole 91 of the engine 90. The installation hole 91 includes a receiving hole portion 92, a relieving hole portion 93, and a fitting hole portion 94. A lower end surface 65 of a large diameter portion 63 of the fuel injection valve 60 contacts a bottom surface 95 of the receiving hole portion 92, and a tubular portion 66 of the fuel injection valve 60 is fitted into the fitting hole portion 94.

The fuel injection valve 60 is opened and closed based on a signal, which is inputted from an external control device to a connector 69, so that the fuel injection valve 60 can inject the fuel, which is supplied from the rail main body 70 through the connecting pipe 801, into the engine 90 through the injection hole 68 that is formed at the distal end of the tubular portion 66.

The clip 101 for the fuel injection valve 60 is installed to at least an outer peripheral part of a body portion 61 of the fuel injection valve 60. Hereinafter, the clip 101 for the fuel injection valve will be simply referred to as "clip 101". Furthermore, the clip 101 and the fuel injection valve 60, to which the clip 101 is installed, will be collectively referred to as "a fuel injection valve unit."

In the installed state where the clip 101 is installed to the fuel injection valve 60, the clip 101 is clamped between a pressing surface 86, which is a lower end surface of the connecting pipe 801, and a contactable surface 64, which is an upper end surface of the large diameter portion 63 of the fuel injection valve 60. In this way, the clip 101 holds the fuel injection valve 60 at the location between the rail main body 70 and the connecting pipe 801, which are located on one side of the fuel injection valve 60, and the engine 90, which is located on the other side of the fuel injection valve 60.

The clip 101 includes a load transmitting member 11 and a fitting member 201. The load transmitting member 11 is formed from a single wire material. The fitting member 201 is formed separately from the load transmitting member 11.

Hereinafter, at the time of describing the configuration of the clip 101, an axis J of the fuel injection valve 60 shown in FIGS. 7 and 8 serves as a reference for positions and directions. Thus, the axis J of the fuel injection valve 60, to which the clip 101 is installed, is defined as an imaginary axis and is used to identify the clip 101 regardless of whether the fuel injection valve 60 is actually present or not.

Furthermore, three dimensional directions will be defined as follows while the imaginary axis is used as the reference.

First of all, a direction, which is parallel to the imaginary axis, will be defined as a z-direction. Furthermore, a direction toward the connecting pipe 801 in the z-direction will be referred to as a plus z-direction, and a direction toward the fuel injection valve 60 in the z-direction will be referred to as a minus z-direction. That is, an upward direction in FIGS. 7 and 8 is the plus z-direction, and a downward direction in FIGS. 7 and 8 is the minus z-direction.

Furthermore, a specific direction in a plane that is perpendicular to the imaginary axis J will be defined as a y-direction. In the first embodiment and the following second embodiment, a direction toward the connector 69 of the body portion 61 will be commonly referred to as a minus y-direction, and an opposite direction, which is opposite from the connector 69, will be commonly referred to as a plus y-direction. In the first embodiment, a fittable portion 81 of the connecting pipe 801 is placed at a side in the plus y-direction. Furthermore, a direction, which is perpendicular to both of the z-direction and the y-direction, will be referred to as an x-direction. A plus direction of the x-direction and a minus direction of the x-direction are not positively distinguished in this discussion.

Thus, the left-to-right direction in FIG. 7 is the x-direction. Furthermore, the right direction in FIG. 8 is the plus y-direction, and the left direction in FIG. 8 is the minus y-direction. In the drawings, the plus direction is indicated by "+", and the minus direction is indicated by "−".

Next, a structure of the clip 101 shown alone will be described with reference to FIGS. 1(*a*) to 2(*b*), and details of the structure of the fitting member 201 will be described with reference to FIGS. 3 and 4.

Here, a side of the clip 101 viewed from the side in the plus y-direction is defined as a front surface side of the clip 101, and an opposite side of the clip 101 is defined as a back surface side. FIG. 1(*a*) is a perspective view of the clip 101 viewed from the front surface side, and FIG. 1(*b*) is a perspective view of the clip 101 viewed from the back surface side. Furthermore, FIG. 2(*a*) is a back view of the clip 101, and FIG. 2(*b*) is a side view of the clip 101.

First of all, the load transmitting member 11 will be described. The load transmitting member 11 is also commonly used in the second embodiment.

Figure 1A:
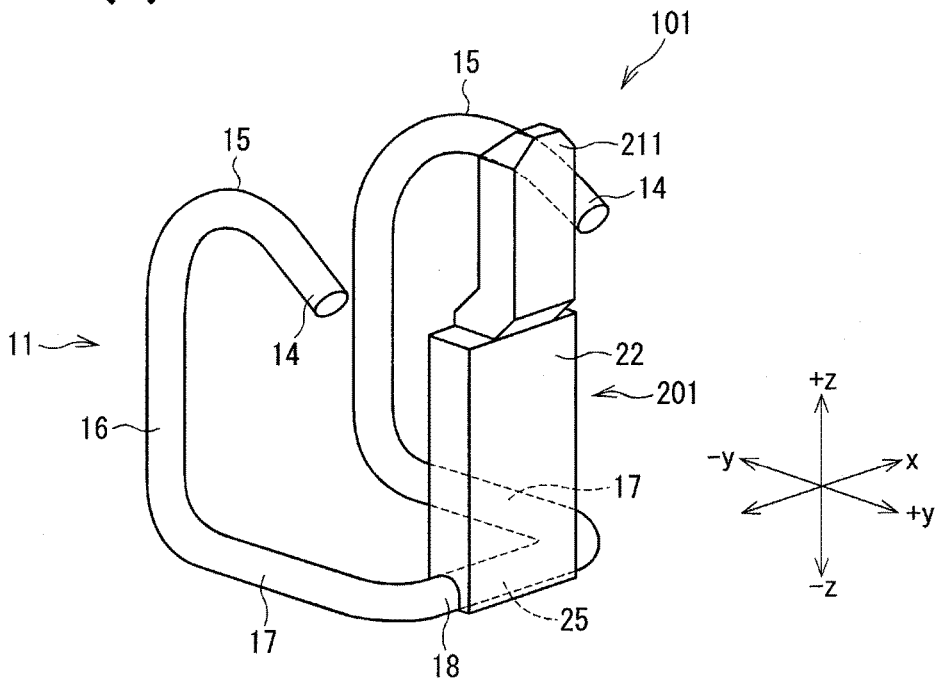
FIG. 1(*a*) is a perspective view of a clip for a fuel injection valve according to a first embodiment of the present disclosure viewed from a front surface side of the clip, and FIG. 1(*b*) is another perspective view of the clip for the fuel injection valve of FIG. 1(*a*) viewed from a back surface side of the clip.
Figure 1B:
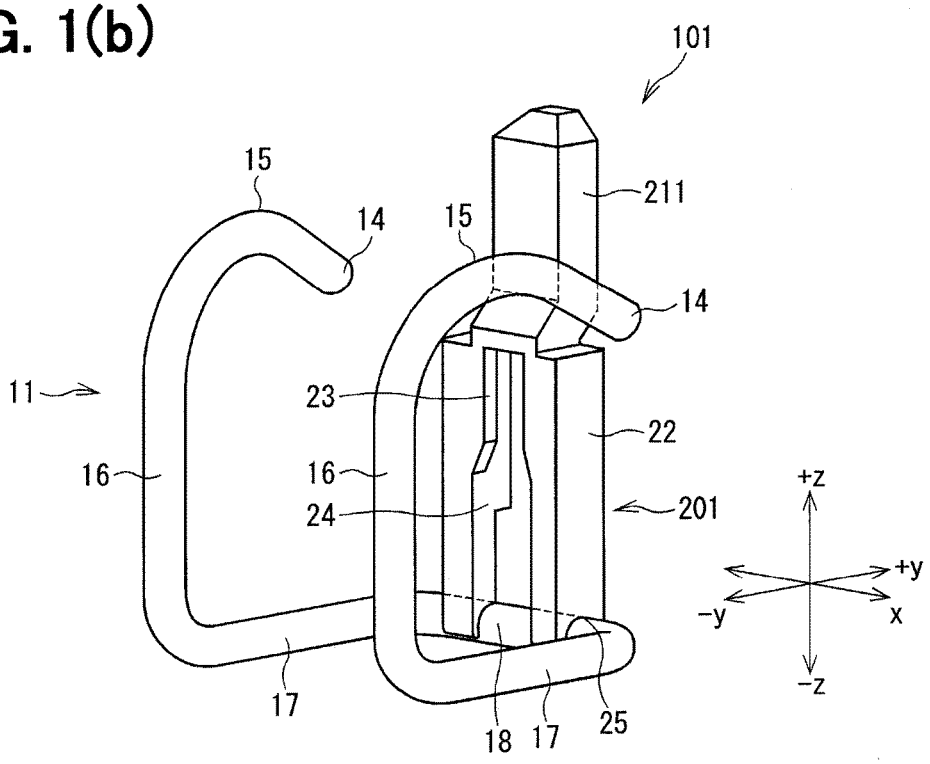

As shown in FIGS. 1(*a*) to 2(*b*), the load transmitting member 11 is formed by bending a single wire material at a plurality of locations. The wire material has spring elasticity and is made of, for example, metal, such as stainless steel. Hereinafter, each portion of the wire material, which is bent, is named and described in view of its function. The clip 101 is formed symmetrically on two sides of a y-z plane, which extends through the imaginary axis J and serves as a plane of symmetry. Thus, the clip 101 is formed such that a pair of respective identical portions is provided (i.e., the number of each identical portions is two) except a connecting portion 18 that extends from one side to the other side of the plane of symmetry.

In the wire material, a depressible portion 15, a spring portion 16, a contacting portion 17 and the connecting portion 18 are arranged one after another in this order from an end portion 14 on the one side of the plane of symmetry. Furthermore, the connecting portion 18, another contacting portion 17, another spring portion 16, another depressible portion 15 and another end portion 14 are arranged one after another in this order, which is opposite from the above described order, from the plane of symmetry on the other side of the plane of symmetry.

A location of each contacting portion 17 in the z-direction is constant along its length and thereby linearly extends in the y-direction. Therefore, when the clip 101 is placed on a horizontal plane while the contacting portions 17 are placed at the lower side on the horizontal plane, the z-direction, which is the axial direction of the imaginary axis J, coincides with a vertical direction, and the x-direction and the y-direction coincide with horizontal directions, respectively. In the following description, this orientation of the clip 101 is considered as a basic orientation of the clip 101, so that the plus z-direction is referred to as an upward direction, and the minus z-direction is referred to as a downward direction.

Each depressible portion 15 is placed immediately above an intermediate part of the corresponding contacting portion 17 such that the depressible portion 15 is located at a peak, i.e., a maximum of a ridge. In a case where the wire material has a circular cross section, a single point of a circle of this cross section, which contacts the pressing surface 86, serves as the depressible portion 15 in the strict sense. However, when the depressible portion 15 is depressed from its free state, the location of this contact point slightly shifts. Furthermore, the contact point may vary due to dimensional variations of the components. Therefore, in reality, a certain range of the wire material, which includes the contact point of the wire material that contacts the pressing surface 86, will be considered as the depressible portion 15. It is possible to say that the depressible portion 15 is placed at the highest point of the load transmitting member 11.

Each spring portion 16 extends from one end of the corresponding contacting portion 17 in the upward direction and connects between the one end of the corresponding contacting portion 17 and the corresponding depressible portion 15. The spring portion 16 is resiliently deformed by a portion of the load applied to the depressible portion 15 in the downward direction and conducts the load, which is applied in the downward direction, to the contacting portion 17. More precisely, the remaining load, which remains after subtracting the consumed load consumed by the resilient deformation of the spring portion 16 from the load applied to the depressible portion 15 in the downward direction, is conducted to the contacting portion 17.

As shown in FIGS. 7 and 8, in the state where the clip 101 is installed to the fuel injection valve 60, the contacting portion 17 contacts the contactable surface 64, which is the upper end surface of the large diameter portion 63 of the fuel injection valve 60. The depressible portion 15 contacts the pressing surface 86, which is the lower end surface of the connecting pipe 801. In this way, the clip 101 is clamped between the contactable surface 64, which is directed in the plus z-direction, and the pressing surface 86, which is directed in the minus z-direction.

Figure 2A:
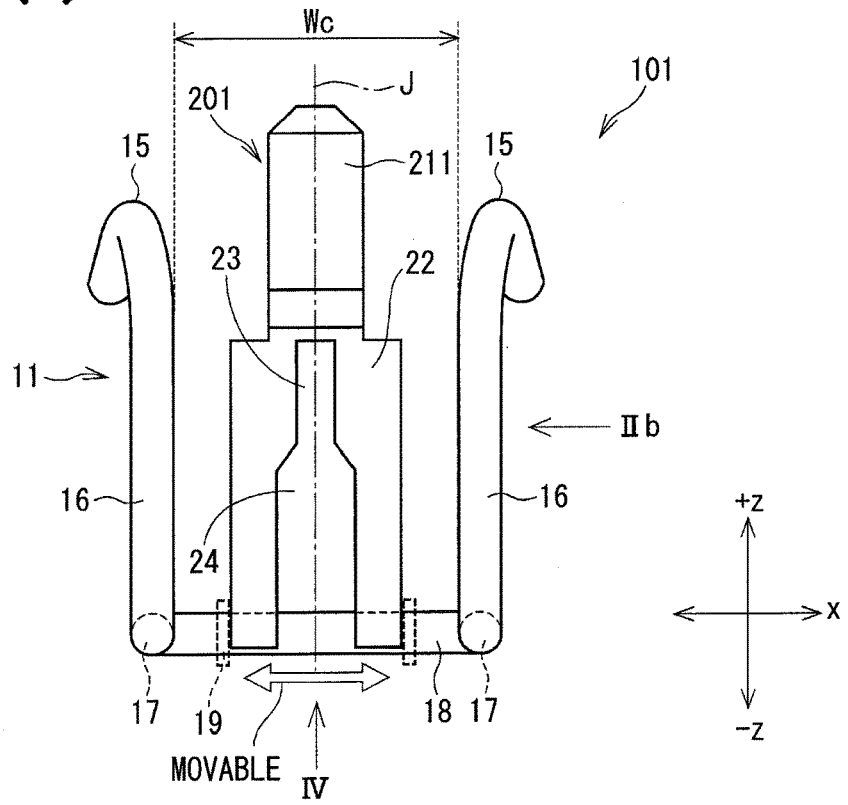
FIG. 2(*a*) is a back view of the clip for the fuel injection valve shown in FIGS. 1(*a*) and 1(*b*), and FIG. 2(*b*) is a side view of the clip for the fuel injection valve shown in FIG. 2(*a*).
Figure 2B:
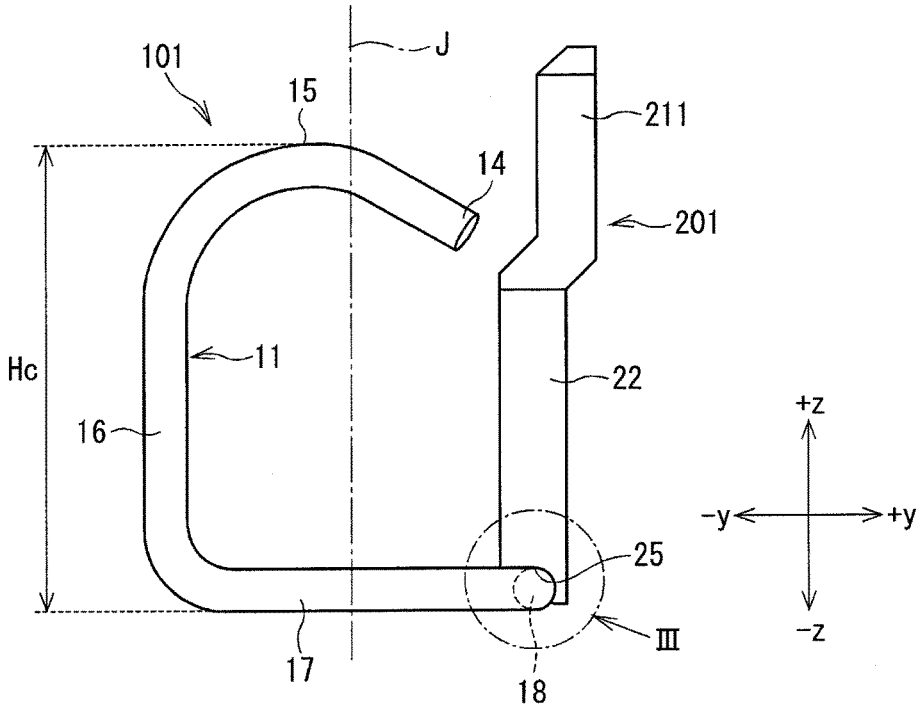

Since the free height Hc (see FIG. 2(*b*)), which is measured from the contacting portion 17 of the clip 101 to the depressible portion 15, is set to be larger than the distance Hi, which is measured between the contactable surface 64 and the pressing surface 86, the depressible portion 15 is depressed in the minus z-direction by the pressing surface 86 upon installation of the clip 101. Thereby, the contacting portion 17 urges the contactable surface 64, so that the lower end surface 65 of the large diameter portion 63 is urged against the bottom surface 95 of the receiving hole portion 92. Thus, the fuel injection valve 60 is held in the installation hole 91 of the engine 90 without inducing wobbling of the fuel injection valve 60.

The depressible portion 15 is depressed by the pressing surface 86 in this manner, so that in view of the load balance, it is desirable that the depressible portion 15 is relatively adjacent to the imaginary axis J in the y-direction.

Furthermore, the total number of the contacting portions 17 is two, and these two contacting portions 17 are respectively placed on one side and the other side of the imaginary axis J in the x-direction. The connecting portion 18 connects between these two contacting portions 17 in the x-direction on the side of the contacting portions 17, which is opposite from the spring portions 16. A distance We (see FIG. 2(*a*)) between these two contacting portions 17 is set to be generally equal to a width Wi (see FIG. 7) of the body portion 61 of the fuel injection valve 60, and the fuel injection valve 60 is clamped between these two contacting portions 17.

Furthermore, in the first embodiment, the connecting portion 18 is connected to the contacting portions 17 at the same height as that of the contacting portions 17 measured in the z-direction, and the connecting portion 18 and the contacting portions 17 contact the contactable surface 64.

Next, the fitting member 201 of the first embodiment will be described.

The fitting member 201 is made of, for example, a resin material, and is formed separately from the load transmitting member 11. The fitting member 201 is shaped into a plate form that extends in the z-direction. A fitting end portion 211, which is fittable to the fittable portion 81, is formed at one end portion of the fitting member 201 in the plus z-direction, and a connecting portion 25, which is connected to the connecting portion 18 of the load transmitting member 11, is formed at the other end portion of the fitting member 201 in the minus z-direction. Furthermore, a clip side engaging portion 23 and an introducing portion 24 are recessed in a back surface of a main body portion 22 of the fitting member 201.

In the state of the clip 101 alone, the fitting end portion 211 extends from the main body portion 22 such that the fitting end portion 211 extends further beyond the depressible portion 15, which is the highest point of the load transmitting member 11, in the plus z-direction.

The connecting pipe 801 and the clip 101 are positioned relative to each other by fitting the fitting end portion 211 into the fittable portion 81. Furthermore, when the fuel injection valve 60 is clamped between the contacting portions 17 of the clip 101, the relative rotation between the fuel injection valve 60 and the connecting pipe 801 is limited through the clip 101.

Figure 3:
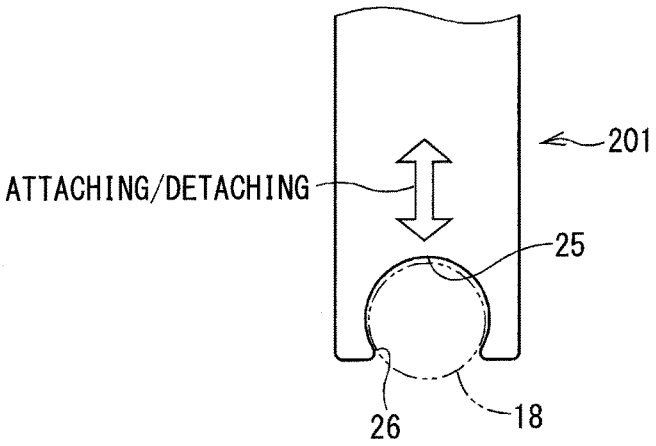
FIG. 3 is an enlarged view of an area III in FIG. 2(*a*).
Figure 4:
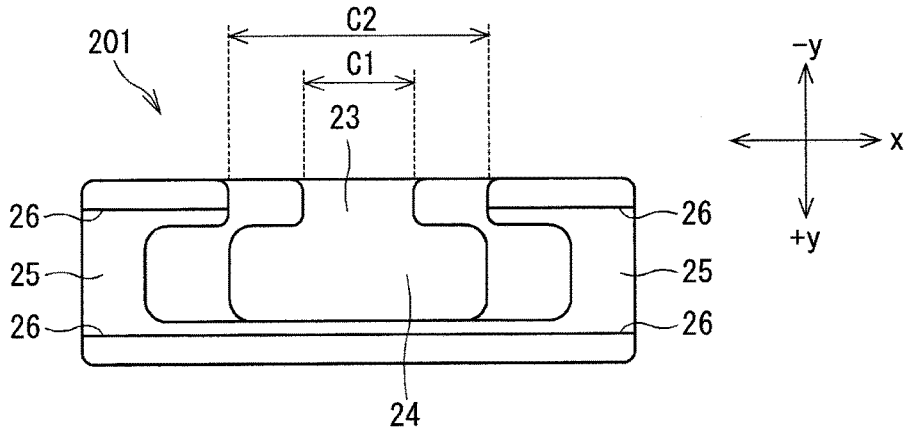
FIG. 4 is an enlarged view taken in a direction of an arrow IV in FIG. 2(*a*).

As shown in FIG. 3, the connecting portion 25 is in a form of an arcuate groove, which extends arcuately through a circumferential extent that is slightly larger than a circumferential extent of a semicircle, and two snap fit parts 26 are formed at two ends of the arc of the connecting portion 25. An inner diameter of the connecting portion 25 is set to be equal to or slightly larger than a wire diameter of the load transmitting member 11. Thereby, when an opening end of the connecting portion 25 is urged against the connecting portion 18 of the load transmitting member 11, the snap fit parts 26 are outwardly and resiliently deformed and are connected to the connecting portion 18. Furthermore, when the snap fit parts 26, which are connected to the connecting portion 18, are pulled away from the connecting portion 18, the snap fit parts 26 are removed from the connecting portion 18. That is, the fitting member 201 of the first embodiment is attachably and detachably connected to the load transmitting member 11.

Furthermore, as indicated by a blank arrow in FIG. 2(*a*), the fitting member 201, which is connected to the connecting portion 18, is allowed to move within a predetermined range in the x-direction through slide movement of an inner wall of the connecting portion 25 along an outer wall of the connecting portion 18.

Alternatively, for example, in a case where a limiting member 19, which is indicated by a dot-dot-dash line, is installed to the load transmitting member 11, the movement of the fitting member 201, which is connected to the connecting portion 18, is limited.

As shown in FIGS. 1(*a*) to 2(*b*) and 4, the clip side engaging portion 23 is formed at the upper side of the back surface of the main body portion 22 such that a groove width C1 of the clip side engaging portion 23, which is measured at the surface of the main body portion 22, is smaller than a groove width C2 of the clip side engaging portion 23, which is measured at a bottom side of the clip side engaging portion 23. That is, inner peripheral edge parts of the groove at the surface side are inwardly projected toward each other.

The introducing portion 24 is formed to extend from the clip side engaging portion 23 to an end portion of the fitting member 201, which is located on a side where the connecting portion 25 is placed. A groove width of the introducing portion 24 is equal to or larger than the groove width C2 of the clip side engaging portion 23, which is measured at the bottom side of the clip side engaging portion 23.

Next, a construction of a fuel injection valve side engaging portion 62 of the fuel injection valve 60, to which the clip 101 is installed, will be described with reference to FIGS. 5(*a*) and 5(*b*), and a construction, in which the clip side engaging portion 23 of the fitting member 201 is engaged to the fuel injection valve side engaging portion 62, will be described with reference to FIG. 6.

Figure 5A:
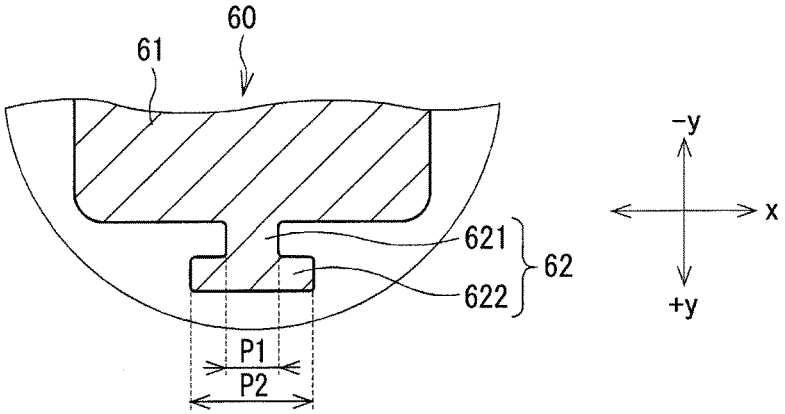
FIG. 5(*a*) is a cross sectional view taken along line Va-Va in FIG. 5(*b*), indicating a fuel injection valve side engaging portion, to which the clip for the fuel injection valve according to the first embodiment of the present disclosure is installed, and FIG. 5(*b*) is a front view of the fuel injection valve side engaging portion according to the first embodiment.
Figure 5B:
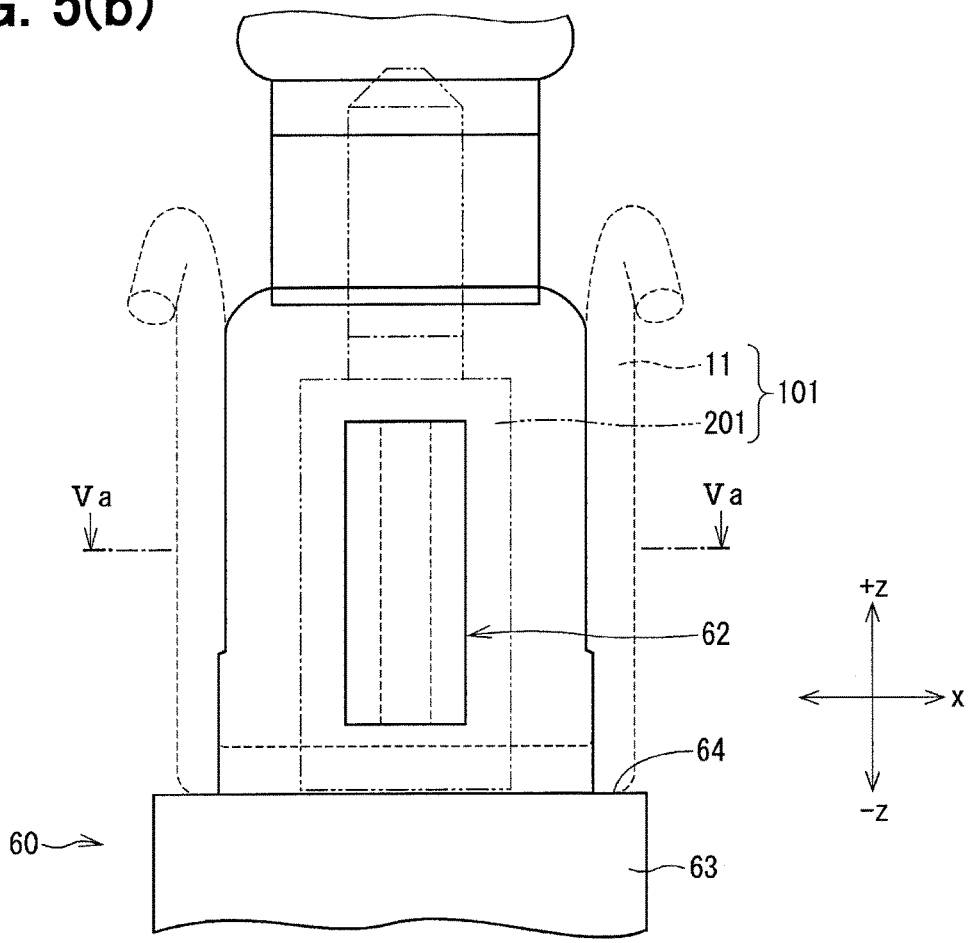

As shown in FIGS. 5(*a*) and 5(*b*), the fuel injection valve side engaging portion 62, which is in a form of a ridge having a shape of a rail, extends in the z-direction in the front surface of the body portion 61 of the fuel injection valve 60. The fuel injection valve side engaging portion 62 includes a stay part 621 and a flange part 622. The flange part 622 has a width P2 that is larger than a width P1 of the stay part 621.

Figure 6:
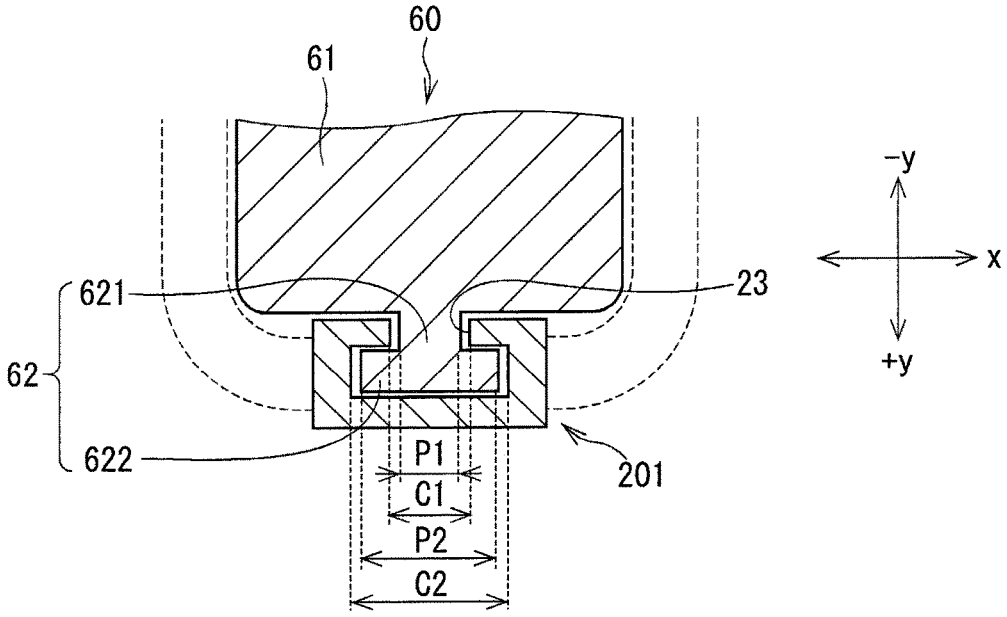
FIG. 6 is a cross sectional view indicating a state where the clip side engaging portion of FIG. 5(*a*) is engaged to the fuel injection valve side engaging portion.

As shown in FIG. 6, the groove width C1 of the clip side engaging portion 23, which is measured at the surface of the main body portion 22, is slightly larger than the width P1 of the stay part 621, and the groove width C2 of the clip side engaging portion 23, which is measured at the bottom side of the clip side engaging portion 23, is slightly larger than the width P2 of the flange part 622. Furthermore, the dimensions of these parts measured in the y-direction are similarly set.

With the above-described construction, when the introducing portion 24 of the fitting member 201 is downwardly slid from a state where the introducing portion 24 is opposed to an upper end part of the fuel injection valve side engaging portion 62, the clip side engaging portion 23 is engaged to the fuel injection valve side engaging portion 62. Thus, the fitting member 201 is assembled to the body portion 61 of the fuel injection valve 60.

Assembling methods of the clip 101 to the fuel injection valve 60 include two methods, i.e., "a sequentially assembling method" and "an off-line set-up method".

The sequentially assembling method is a method of assembling the load transmitting member 11 to the fuel injection valve 60 and then connecting the fitting member 201 to the load transmitting member 11. In this method, the clip 101 is not passed alone through a manufacturing process.

The off-line set-up method is a method of constructing the clip 101 by connecting the fitting member 201 to the load transmitting member 11 and then assembling the clip 101 to the fuel injection valve 60.

The clip 101 of the first embodiment can be used in both of the sequentially assembling method and the off-line set-up method. Therefore, a suitable method, which is suitable for manufacturing steps, may be appropriately selected from these methods. Furthermore, even in a case where components of used products after use are disassembled after collecting of the used products from the market, these components can be disassembled by reversing the assembling procedure of the sequentially assembling method or the off-line set-up method.

Advantages

Now, advantages of the clip 101 of the first embodiment will be described. The load transmitting member 11 of the clip 101 is formed by bending the single wire material at the multiple locations, so that the processing costs can be reduced in comparison to the support clamp of the patent literature 1 (JP5126083B2), which is formed through press working of the plate material.

Furthermore, the clip 101 of the first embodiment has the following advantages (1) to (5) over the support clamp (clip) of the non-patent literature 1 (JAPAN INSTITUTE OF INVENTION AND INNOVATION, JOURNAL OF TECHNICAL DISCLOSURE No. 2014-500735). Each number in parentheses, which is recited below and indicates the corresponding advantage, corresponds to the corresponding claim number of the claims at the time of filing the present application.

(1) The clip 101 is characterized in that the load transmitting member 11 and the fitting member 201 are formed separately from each other while the load transmitting member 11 includes the depressible portions 15, the spring portions 16 and the contacting portions 17 and is operable to transmit the load received from the connecting pipe 801 to the fuel injection valve 60, and the fitting member 201 includes the connecting portion 25, which is connected to the load transmitting member 11, and the fitting end portion 211, which is fittable to the fitting member 201. The advantages of this construction will be described mainly with reference to FIG. 9 in comparison to comparative examples shown in FIGS. 14 to 16.

Figure 14:
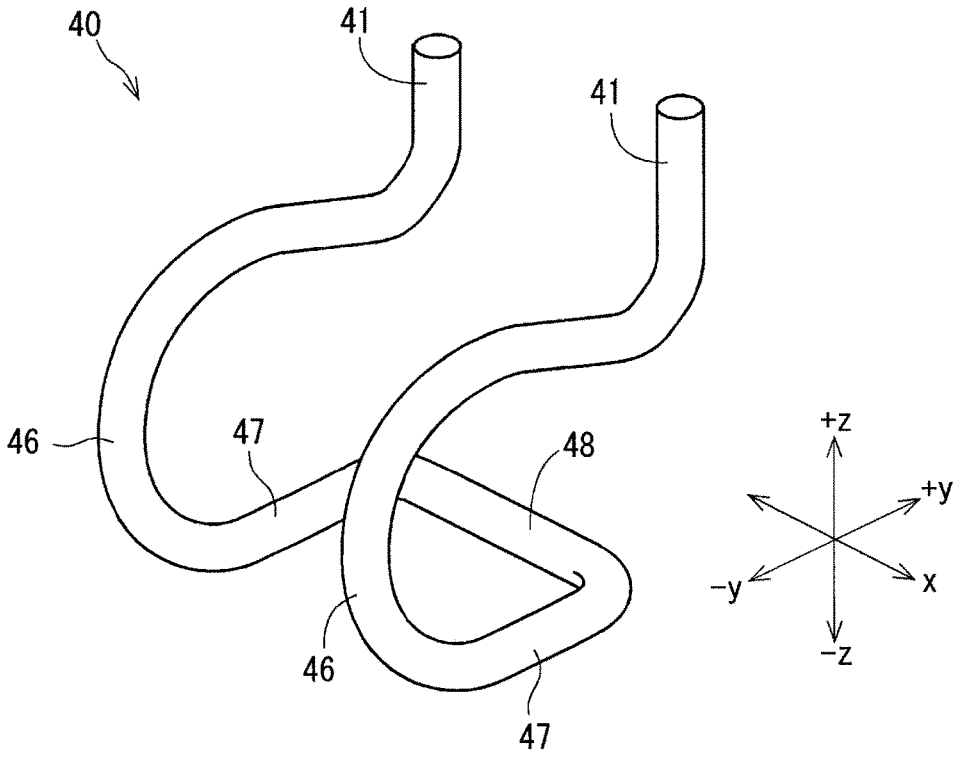
FIG. 14 RELATED ART
FIG. 14 is a perspective view of a clip for a fuel injection valve according to a first comparative example viewed from a back surface side of the clip.

A clip 40 of a first comparative example shown in FIG. 14 is the one shown in drawings of the non-patent literature 1 while changing the reference signs. In the following discussion, with respect to technical terms, "a revolution limiting portion" of the non-patent literature 1 is changed to "a rotation limiting portion 41", and "an engaging portion" is changed to "a contacting portion 47." A connecting portion 48 of FIG. 14 connects between two contacting portions 47 in the x-direction on an opposite side of the contacting portions 47, which is opposite from spring portions 46.

As shown in FIG. 14, in the clip 40 of the first comparative example, each rotation limiting portion 41 is formed continuously from the corresponding spring portion 46. That is, the clip 40 of the first comparative examples is clearly different from the clip 101 of the first embodiment with respect to that the rotation limiting portions 41 are formed integrally with the spring portions 46 in the clip 40 of the first comparative example.

Figure 15:
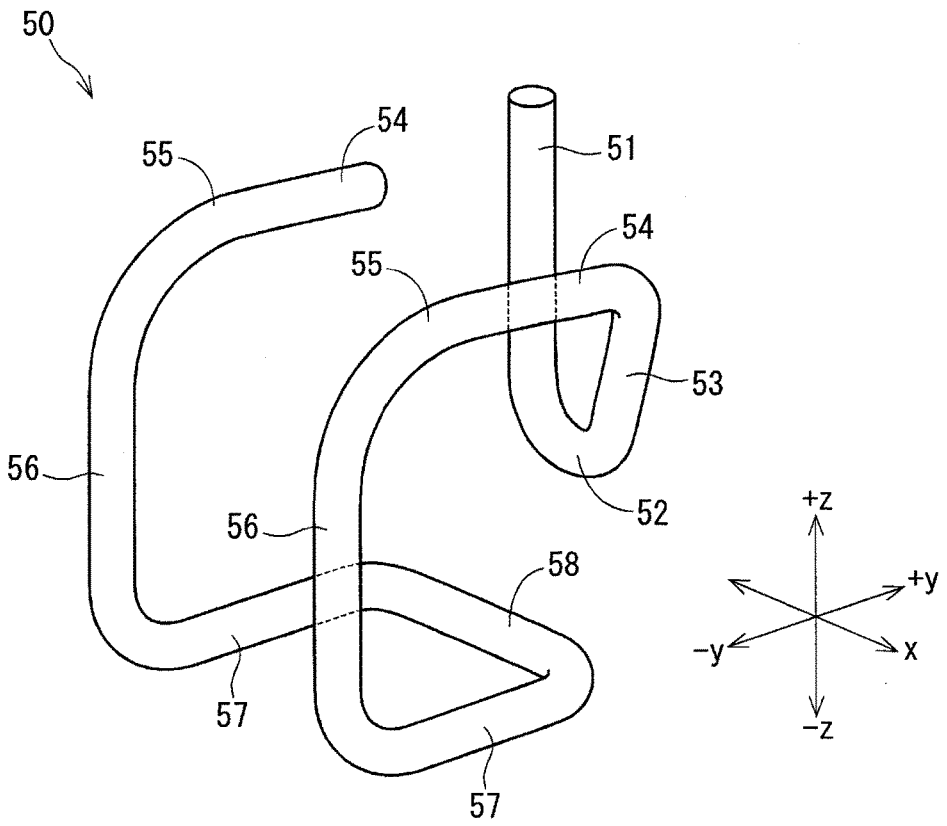
FIG. 15 RELATED ART
FIG. 15 is a perspective view of a clip for a fuel injection valve according to a second comparative example viewed from a back surface side of the clip.

Since the clip 40 of the first comparative example is significantly different from the clip 101 of the first embodiment with respect to, for example, the size of the spring portions 46, a second comparative example, which is a modification of the first comparative example that is modified to ease comparison with the first embodiment, is shown in FIG. 15. The definitions of the respective directions indicated in the drawing are the same as those of the first embodiment.

In the clip 50 of the second comparative example, a single rotation limiting portion 51 is u-turned at a turning portion 52 and is connected to a depressible portion 55 through a longitudinal connecting portion 53 and a lateral connecting portion 54. The spring portion 56 is bent from the depressible portion 55 generally at the right angle and extends in the downward direction. The contacting portion 57 is bent from the spring portion 56 generally at the right angle, and thereafter the contacting portion 57 extends in the horizontal direction and is connected to the connecting portion 58. Similar to the first comparative example, in the clip 50 of the second comparative example, the rotation limiting portion 51 is formed integrally with the spring portion 56 and the other remaining portions.

Figure 16:
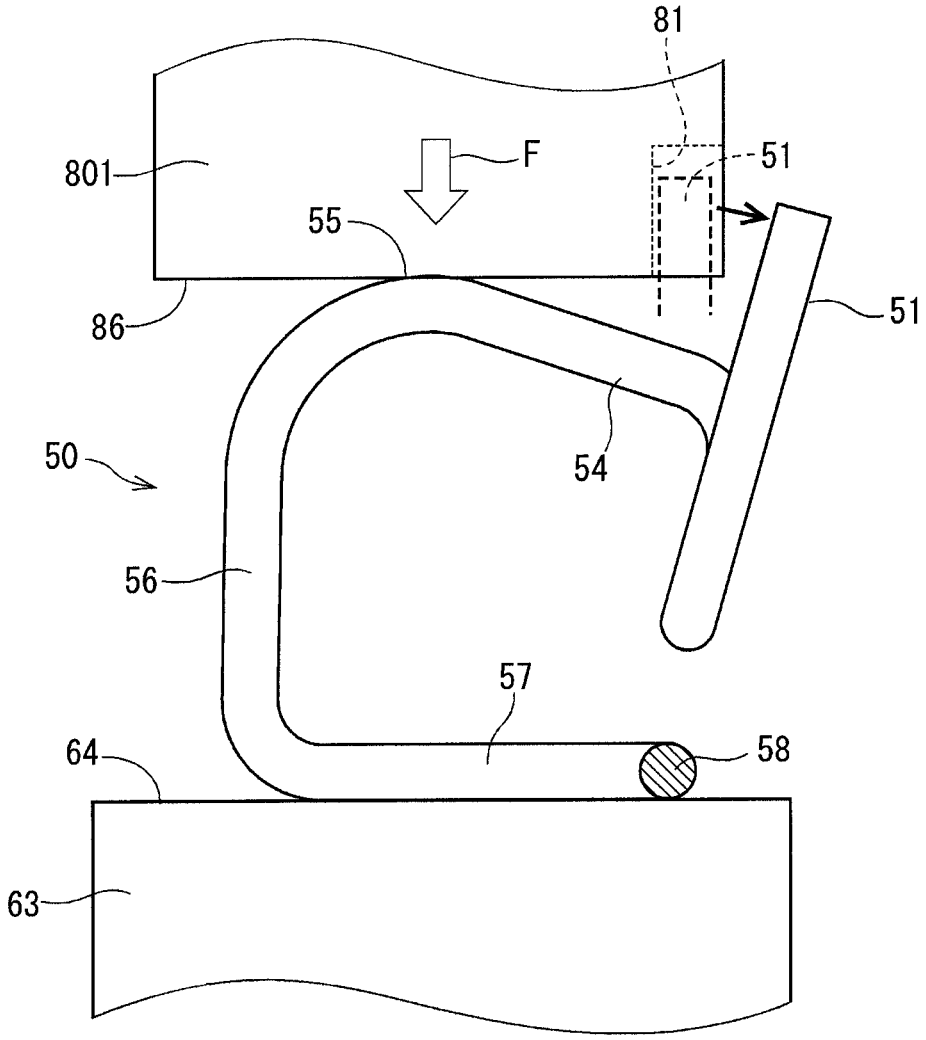
FIG. 16 RELATED ART
FIG. 16 is a diagram indicating a state where a depressible portion of the clip for the fuel injection valve according to the second comparative example is depressed.

As shown in FIG. 16, in the clip 50 of the second comparative example, when the depressible portion 55 receives a load F from the pressing surface 86, the lateral connecting portion 54 is flexed and is tilted, and a moment of the lateral connecting portion 54 is transmitted to the rotation limiting portion 51. Therefore, there is a possibility of disengaging the rotation limiting portion 51 from the fittable portion 81 of the connecting pipe 801.

Figure 9:
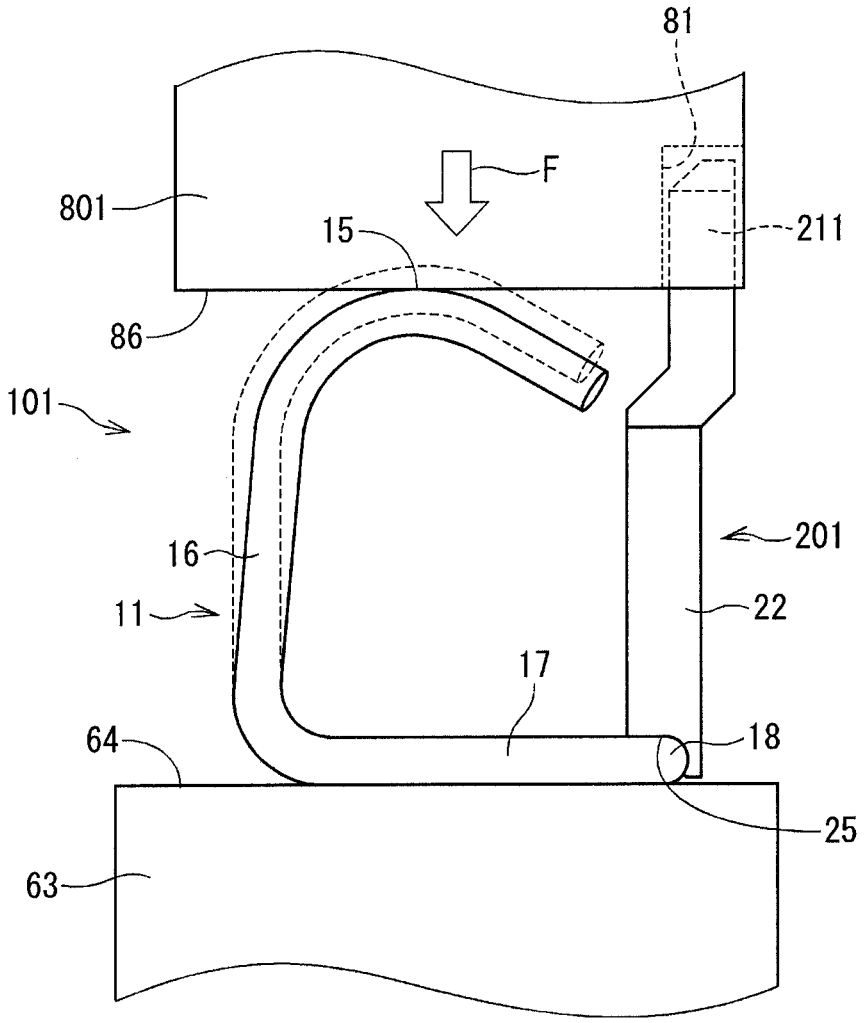
FIG. 9 is a diagram indicating a state where a depressible portion of the clip for the fuel injection valve shown in FIGS. 1(*a*) and 1(*b*) is depressed.

In contrast, as shown in FIG. 9, in the clip 101 of the first embodiment, the fitting member 201, which has the rotation limiting function, is formed separately from the load transmitting member 11. Therefore, even in the case where the depressible portion 15 receives the load F from the pressing surface 86, and thereby the spring portion 16 is deformed, the stress is less likely transmitted to the fitting end portion 211 of the fitting member 201. Thus, it is possible to limit disconnecting of the fitting end portion 211 from the fittable portion 81 of the connecting pipe 801.

(2) The number of the contacting portions 17 is two, and these two contacting portions 17 are respectively placed on the one side and the other side of the imaginary axis J in the x-direction. Furthermore, the load transmitting member 11 includes the connecting portion 18, which connects between these two contacting portions 17 on the opposite side of the contacting portions 17, which is opposite from the spring portions 16.

The body portion 61 of the fuel injection valve 60 is clamped between the two contacting portions 17, so that the position of the clip 101 relative to the fuel injection valve 60 is stabilized. This advantage becomes more prominent by setting the distance We between the two contacting portions 17 to be substantially equal to the width Wi of the fuel injection valve.

(3) In the case of the construction, in which the fitting member 201 is connected to the load transmitting member 11 in a manner that enables movement of the fitting member 201 relative to the load transmitting member 11 within a predetermined range, at the operation of assembling the fitting member 201 to the load transmitting member 11, or the operation of installing the clip 101, which is preassembled by the off-line set-up method, to the fuel injection valve 60, it is possible to finely adjust the position of the fitting member 201. Therefore, the variations in the component sizes or the assembling positions can be appropriately absorbed.

(4) In contrast, in the case of the construction, in which the fitting member 201 is connected to the load transmitting member 11 in a manner that limits movement of the fitting member 201 relative to the load transmitting member 11, at the operation of assembling the fitting member 201 to the load transmitting member 11, or the operation of installing the clip 101, which is preassembled by the off-line set-up method, to the fuel injection valve 60, since the position of the fitting member 201 is fixed, the operations can be performed in the stabilized state.

(5) In the case of the construction, in which the fitting member 201 is attachably and detachably connected to the load transmitting member 11 regardless of whether the movement of the fitting member 201 relative to the load transmitting member 11 is enabled, recycling of the fitting member 201 is possible in the following manner. That is, the clip 101, which is used in an actual device, is collected from the market and is disassembled into the load transmitting member 11 and the fitting member 201, and only the fitting member 201 is used once again through the recycling.

Furthermore, the fuel injection valve unit, which includes the clip 101 and the fuel injection valve 60 installed with the clip 101, provides the following advantage (6).

(6) The fuel injection valve side engaging portion 62, to which the clip side engaging portion 23 of the fitting member 201 is engageable, is formed in the outer surface of the body portion 61 of the fuel injection valve 60, which is located on the side where the fitting member 201 of the clip 101 is placed. When the clip side engaging portion 23 is engaged to the fuel injection valve side engaging portion 62, the position of the clip 101 relative to the fuel injection valve 60 in the rotational direction can be stabilized.

Furthermore, by fitting the fitting end portion 211 to the fittable portion 81 of the connecting pipe 801, the fuel injection valve 60 can be positioned relative to the connecting pipe 801 in the rotational direction through the clip 101.

Second Embodiment

Figure 10A:
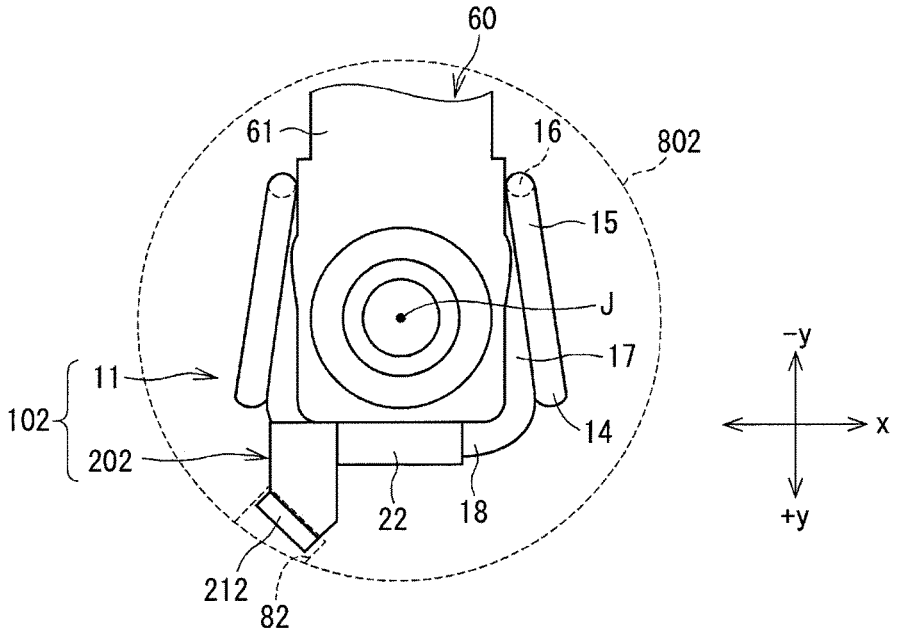
FIG. 10(*a*) is a plan view of a fuel injection valve, to which a clip for the fuel injection valve according to a second embodiment of the present disclosure is installed, and FIG. 10(*b*) is a front view of the fuel injection valve of FIG. 10(*a*).
Figure 10B:
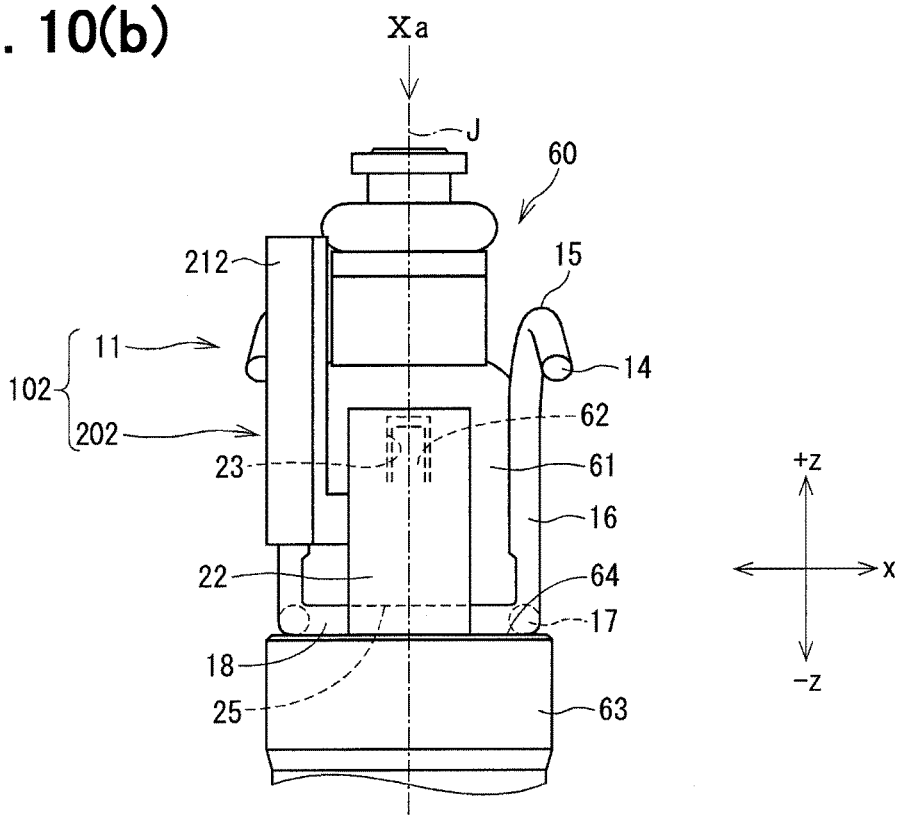

A clip for a fuel injection valve according to a second embodiment will be described with reference to FIGS. 10(*a*) and 10(*b*). The clip 102 of the second embodiment includes the load transmitting member 11, which is the same as that of the first embodiment, and a fitting member 202, which has a different configuration from that of the first embodiment.

A connection pipe 802, to which the fuel injection valve 60 having the clip 102 of the second embodiment is installed, is indicated by a dotted line. A location of a fittable portion 82 of the connection pipe 802 is different from that of the connecting pipe 801 shown in FIGS. 7 and 8 of the first embodiment. Specifically, although the fittable portion 81 of the connecting pipe 801 is placed on the side of the imaginary axis J in the plus y-direction, the fittable portion 82 of the connection pipe 802 is placed in a different direction that is deviated from the plus y-direction relative to the imaginary axis J.

The fitting end portion 212 of the fitting member 202 is placed at a location, which is deviated from the main body portion 22, in conformity with a position and an angle of the fittable portion 82. Besides the above described structure, the arrangement of connecting the connecting portion 25 of the fitting member 202 to the connecting portion 18 of the load transmitting member 11 and the arrangement of engaging the clip side engaging portion 23 to the fuel injection valve side engaging portion 62 of the fuel injection valve 60 are similar to those of the first embodiment. Therefore, the clip 102 of the second embodiment can achieve advantages that are similar to the advantages of the first embodiment.

As discussed above, the positional relationships of the fitting end portion, the connecting portion and the clip side engaging portion of the fitting member can be appropriately set according to the configuration and the dimensions of the fuel supply conduit, which serves as an installation subject.

Furthermore, at the time of manufacturing the real products, for instance, in the case where the fitting member 201 of the first embodiment and the fitting member 202 of the second embodiment are manufactured in parallel on the same manufacturing line, the fitting member 201 and the fitting member 202 can be instantaneously distinguished from each other at first glance by molding the fitting member 201 and the fitting member 202 from resin materials of different colors, respectively.

Third and Fourth Embodiments

A clip for a fuel injection valve according to third and fourth embodiments will be described with reference to FIGS. 11(*a*) and 11(*b*).

Figure 11A:
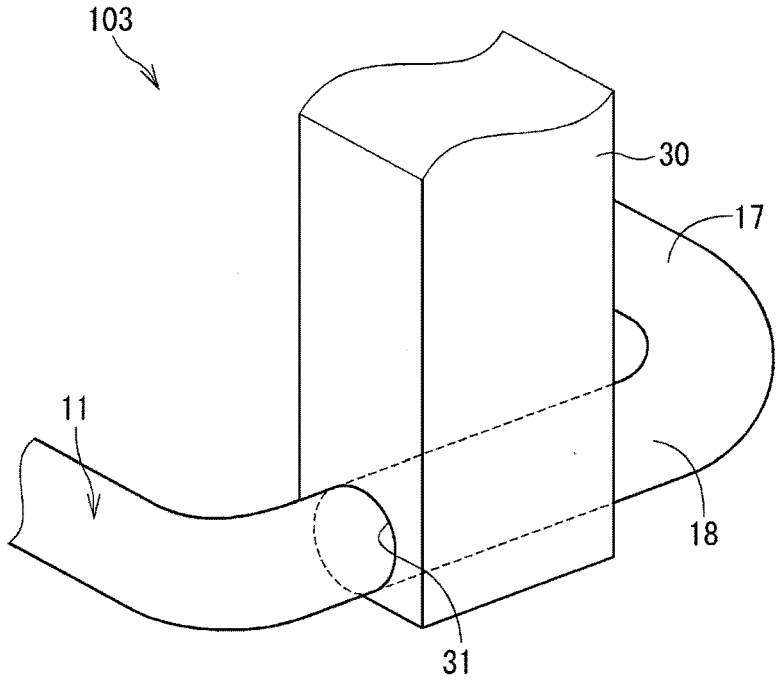
FIG. 11(*a*) is a perspective view indicating a fitting member of a clip for a fuel injection valve according to a third embodiment of the present disclosure, and FIG. 11(*b*) is a perspective view indicating a fitting member of a clip for a fuel injection valve according to a fourth embodiment of the present disclosure.
Figure 11B:
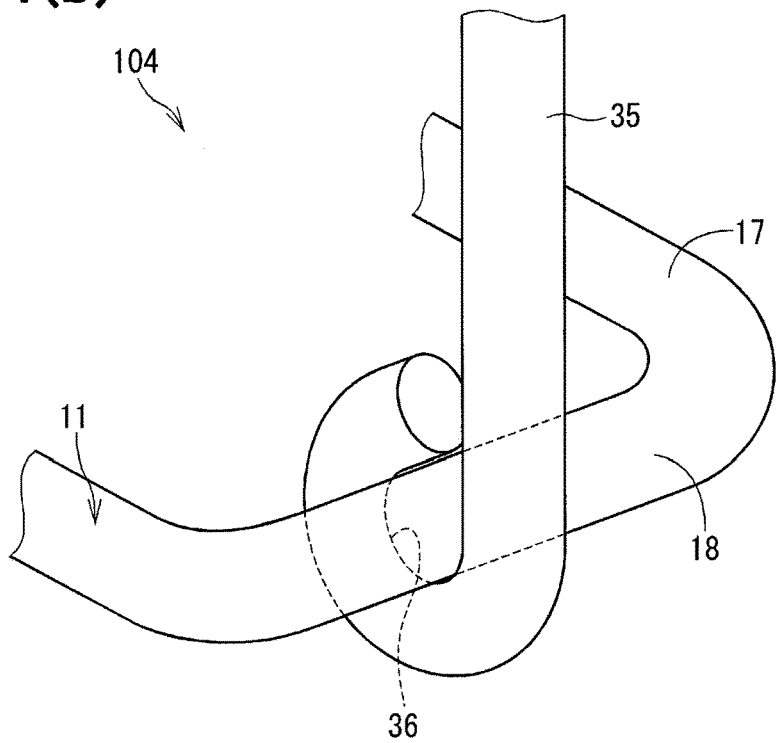

In a clip 103 of the third embodiment shown in FIG. 11(*a*), a fitting member 30, which is a resin molded body, is resin molded together with the connecting portion 18 of the load transmitting member 11. With this construction, the clip 103 after the molding seems to be one-piece body in appearance. However, since the fitting member 30 is initially formed separately from the load transmitting member 11, the fitting member 30 is interpreted as the fitting member, which is formed separately from the load transmitting member 11, according to the present disclosure.

Depending on the characteristics of the molding resin material and/or the surface state of the load transmitting member 11, the connecting portion 31 of the fitting member 30 may be tightly connected to the load transmitting member 11 or may be loosen relative to the load transmitting member 11. Thus, movement of the fitting member 30 relative to the load transmitting member 11 may be limited in some cases and may be enabled in some other cases.

In a clip 104 of a fourth embodiment shown in FIG. 11(*b*), a fitting member 35 is formed from a metal wire material, which is similar to the wire material of the load transmitting member 11. An end portion of the fitting member 35 is bent and is wound around the load transmitting member 11, so that the end portion of the fitting member 35 is connected to the load transmitting member 11. Similar to the third embodiment, even with this construction, the fitting member 35, which is initially formed separately from the load transmitting member 11, is interpreted as the fitting member, which is formed separately from the load transmitting member, according to the present disclosure.

Depending on, for example, the winding strength of the end portion of the fitting member 35, a connecting portion 36 of the fitting member 35 may be tightly connected to the load transmitting member 11 or may be loosen relative to the load transmitting member 11. Thus, movement of the fitting member 35 relative to the load transmitting member 11 may be limited in some cases and may be enabled in some other cases.

The clips 103, 104 of the third and fourth embodiments achieve the advantages (1) to (4) and (6) of the first embodiment.

Figure 12A:
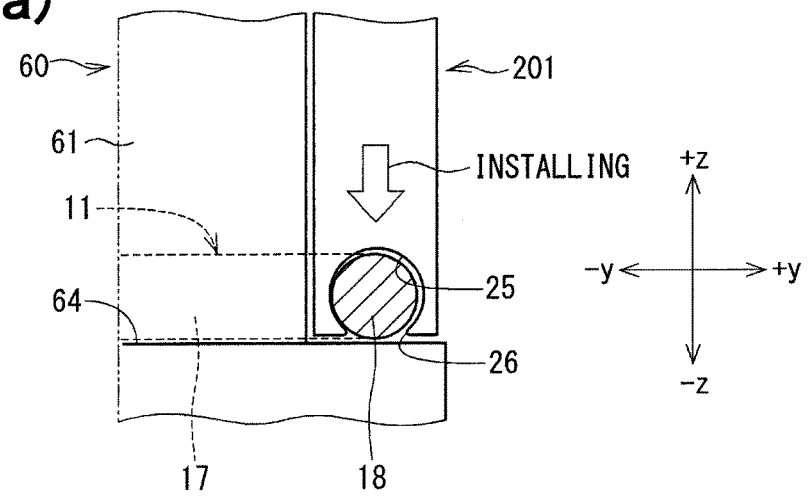
FIGS. 12(*a*) to 12(*c*) are diagrams indicating modifications for a connecting structure between the fitting member and the load transmitting member.
Figure 12B:
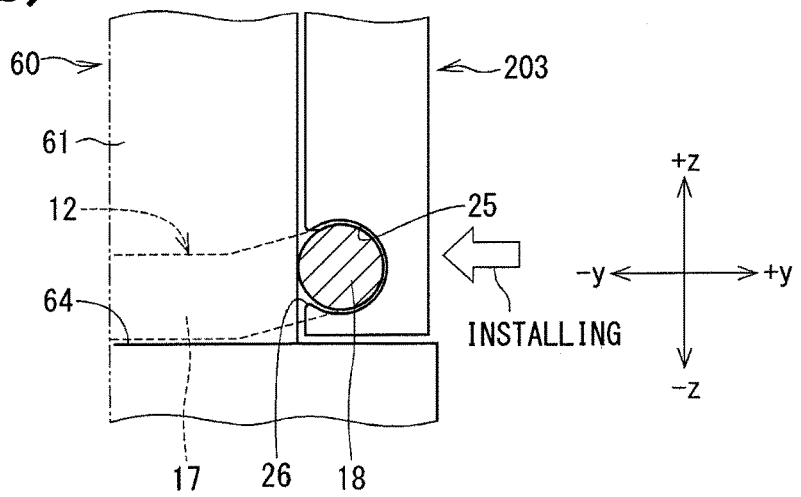
Figure 12C:
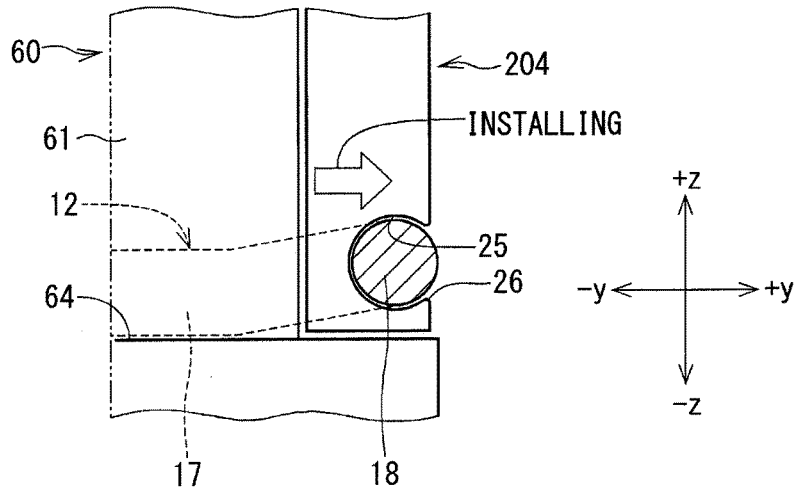

Other Embodiments (A) Modifications of the connecting structure, which connects between the fitting member and the load transmitting member of the first embodiment, are respectively indicated in FIGS. 12(*a*), 12(*b*) and 12(*c*).

FIG. 12(*a*) corresponds to a diagram that shows a cross section of the load transmitting member 11 at an area XIIa in FIG. 8 of the first embodiment. The fitting member 201 is installed to the connecting portion 18 of the load transmitting member 11 from the side in the plus z-direction. With this construction, it is not required to provide a space on the contactable surface 64 side of the connecting portion 18. Therefore, the connecting portion 18 and the contacting portion 17 can be placed on the same plane to contact the contactable surface 64. Furthermore, the assembling method of the clip to the fuel injection valve 60 can be any one of the sequentially assembling method and the off-line set-up method, as discussed above.

In the modifications shown in FIGS. 12(*b*) and 12(*c*), respectively, configurations of the connecting portion 25 and the snap fit part 26 of the fitting member 203, 204 are similar to those of the fitting member 201 of the first embodiment, and the opening direction of the connecting portion 25 is different from the fitting member 201 of the first embodiment.

In the modification shown in FIG. 12(*b*), the fitting member 203 is installed to the connecting portion 18 of the load transmitting member 11 from the side in the plus y-direction. In this construction, it is required to provide a space, which receives the end portion of the fitting member 203, on the contactable surface 64 side of the connecting portion 18. Thus, in the case where the contactable surface 64 is a single planar surface as shown in the drawing, the connecting portion 18 of the load transmitting member 12 is formed by bending the connecting portion 18 relative to the contacting portion 17 in a direction away from the contactable surface 64. Alternatively, a relief portion, which can receive the end portion of the fitting member 203, may be formed at the contactable surface 64. Furthermore, the assembling method of the clip to the fuel injection valve 60 can be any one of the sequentially assembling method and the off-line set-up method.

In the modification shown in FIG. 12(*c*), the fitting member 204 is installed to the connecting portion 18 of the load transmitting member 11 from the side in the minus y-direction. With this construction, it is required to provide the space, which receives the end portion of the fitting member 204, on the contactable surface 64 side of the connecting portion 18, like in the modification of FIG. 12(*b*). Thus, in the case where the contactable surface 64 is the single planar surface, the connecting portion 18 of the load transmitting member 12 is formed by bending the connecting portion 18 relative to the contacting portion 17 in the direction away from the contactable surface 64. Alternatively, a relief portion, which can receive the end portion of the fitting member 204, may be formed at the contactable surface 64. Furthermore, the assembling method of the clip to the fuel injection valve 60 is limited only to the off-line set-up method, in which the fitting member 204 is connected to the load transmitting member 12, and thereafter the entire clip is installed to the fuel injection valve 60.

Figure 13A:
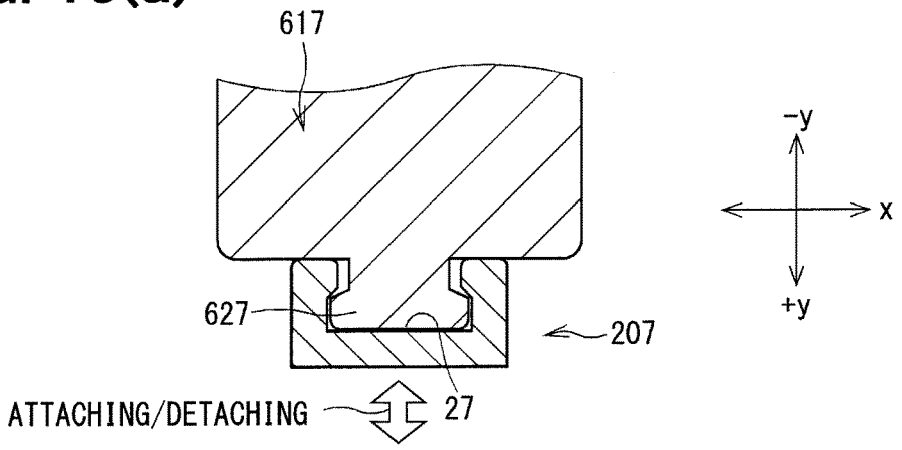
FIGS. 13(*a*) to 13(*c*) are diagrams indicating modifications for an engaging structure between the clip side engaging portion and the fuel injection valve side engaging portion.
Figure 13B:
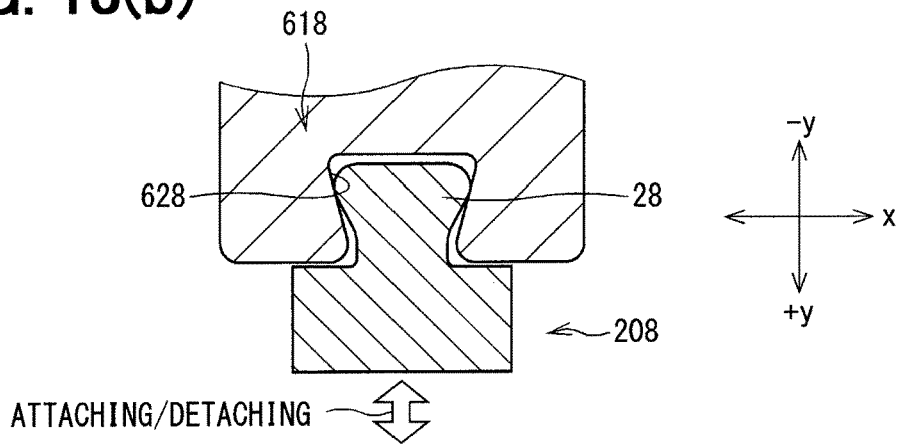
Figure 13C:
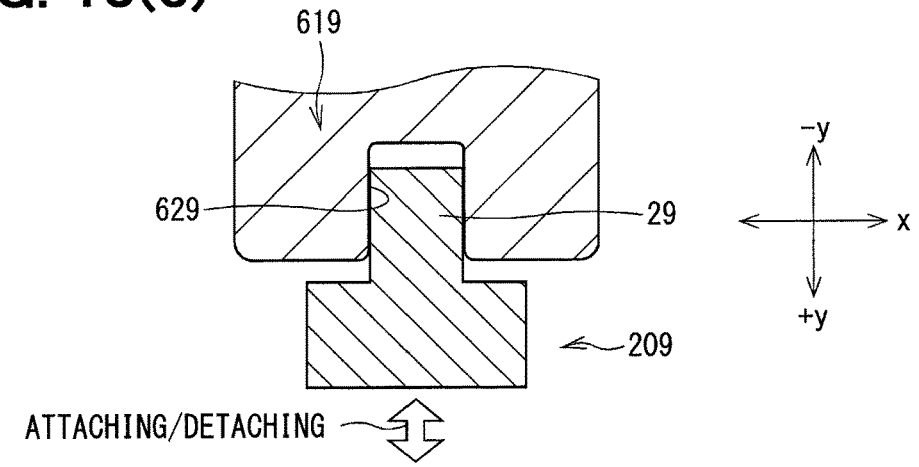

(B) Modifications of the engaging structure, by which the clip side engaging portion and the fuel injection valve side engaging portion are engaged with each other, are shown in FIGS. 13(*a*), 13(*b*) and 13(*c*), respectively. FIGS. 13(*a*), 13(*b*) and 13(*c*) are diagrams, which correspond to FIG. 6 of the first embodiment.

In the modification of FIG. 13(*a*), the clip side engaging portion 27, which is formed in the fitting member 207 and is in a form of a recessed groove, is engaged with the fuel injection valve side engaging portion 627, which is formed in the fuel injection valve body portion 617 and is in a form of a ridge. Similar to the first embodiment, in the fuel injection valve side engaging portion 627, a base of the ridge of the fuel injection valve side engaging portion 627 is constricted, and inner peripheral edge parts of the opening of the clip side engaging portion 27 project inward toward each other. However, in comparison to the first embodiment, the size differences of the constriction and the projection are set to be smaller, and the corners are rounded and smoothened.

In this way, when the fitting member 207 is urged from the side in the plus y-direction against the fuel injection valve side engaging portion 627, the fitting member 207 is resiliently deformed such that a width of the opening of the fitting member 207 is increased to enable engagement of the fuel injection valve side engaging portion 627 into the inside of the fitting member 207 by snap fitting. Furthermore, when the fitting member 207 is pulled in the plus y-direction from the engaged state described above, the fitting member 207 is disconnected from the fuel injection valve side engaging portion 627.

In the modification shown in FIG. 13(*b*), the clip side engaging portion 28, which is formed in the fitting member 208 and is in a form of a ridge, is engaged to the fuel injection valve side engaging portion 628, which is formed in the fuel injection valve body portion 618 and is in a form of a recessed groove. Particularly, in the modification of FIG. 13(*b*), the fuel injection valve side engaging portion 628 is in a form of a dovetail groove, and the clip side engaging portion 28 is in a form of a tenon that is engageable with the dovetail groove.

Furthermore, similar to the modification of FIG. 13(*a*), by setting an angle of an inner surface of the dovetail groove and rounding of the corners, the clip side engaging portion 28 may be engaged to the fuel injection valve side engaging portion 628 by snap fitting in an attachable and detachable manner.

In the modification shown in FIG. 13(*c*), the clip side engaging portion 29, which is formed in the fitting member 209 and is in a ridge form, is engaged to the fuel injection valve side engaging portion 629, which is formed in the fuel injection valve body portion 619 and is in a form of a recessed groove. Particularly, in the modification of FIG. 13(*c*), the clip side engaging portion 29 is formed as the projection, which has a constant width, and the fuel injection valve side engaging portion 629 is formed as the recess, which has a constant width. Therefore, a degree of tightness of the engagement between the clip side engaging portion 29 and the fuel injection valve side engaging portion 629 is adjusted according to the fitting dimensions thereof.

(C) In the above embodiments, the fitting member 201 is connected to the connecting portion 18 of the load transmitting member 11. The present disclosure is not limited to this construction. That is, it is only required that the fitting member is connected to the load transmitting member on the side of the contacting portion, which is opposite from the spring portion. In such a case, movement of the fitting member may be enabled, or the limiting direction for limiting the movement of the fitting member may not be limited to the x-direction and may be the y-direction or an oblique direction in an x-y plane.

(D) In the clip for the fuel injection valve according to the above embodiments, the two contacting portions, the two spring portions and the two depressible portions are respectively and symmetrically placed on the one side and the other side of the imaginary axis J in the x-direction. Alternatively, the two contacting portions, the two spring portions and the two depressible portions may be respectively and asymmetrically placed on the one side and the other side of the imaginary axis J in the x-direction.

Alternatively, one contacting portion, one spring portion and one depressible portion may be formed only on one of the one side and the other side of the imaginary axis J in the x-direction without forming the connecting portion. In such a case, the fitting member is connected to the end of the contacting portion, which is opposite from the spring portion. Even in the case where the contacting portion, the spring portion and the depressible portion are formed only on the one of the one side and the other side of the imaginary axis J, as long as the clip has a predetermined strength, the clip can hold the fuel injection valve 60.

(E) In the above embodiments, the contacting portion 17, which is formed continuously in the y-direction, is counted such that "one contacting portion" is provided on each of the one side and the other side in the x-direction, and the total of "two contacting portions" are provided on the one side and the other side, respectively, in the x-direction. Here, for instance, there is assumed a case wherein a projecting part, which projects in the plus z-direction, is formed in the middle of the contacting portion, so that the portion, which contacts the contactable surface 64, is divided by the projecting part. Even in such a case, the above-described contacting portion may be regarded as the one contacting portion since the divided parts of the contacting portion cooperate with each other on the corresponding one of the one side and the other side in the x-direction to implement the function of contacting the contactable surface 64.

This principle is equally applicable to the other portions of the clip, that is, even in the case where any one or more of the other portions of the clip is not continuously formed, as long as this portion implements the corresponding function through cooperation of the divided parts of the portion, this portion can be considered as "one portion."

(F) The structure of the fuel injection valve, to which the clip of the present disclosure is installed, the structure of the fuel supply conduit, to which the fuel injection valve is installed, and the structure of the internal combustion engine should not be limited to the exemplified ones shown in, for example, FIGS. 7 and 8 of the above embodiment.

The present disclosure should not be limited to the above embodiments and may be implemented in various other forms without departing from the principle of the present disclosure.

The invention claimed is:

1. A clip for a fuel injection valve in a fuel injection apparatus that includes a fuel supply conduit and the fuel injection valve, while the fuel injection valve is connected to the fuel supply conduit and is operable to inject fuel received from the fuel supply conduit into an internal combustion engine through an injection hole, which is formed at a distal end of the fuel injection valve, and the clip is installed to at least a part of an outer peripheral part of the fuel injection valve such that the clip is fitted to a fittable portion that is formed in the fuel supply conduit, and the clip holds the fuel injection valve between the fuel supply conduit and the internal combustion engine, wherein an axis of the fuel injection valve is defined as an imaginary axis, and a direction, which is parallel to the imaginary axis, is defined as a z-direction, while a direction, which is directed toward the fuel supply conduit in the z-direction, is defined as a plus z-direction, and a direction, which is directed toward the distal end of the fuel injection valve in the z-direction, is defined as a minus z-direction, the clip comprising:

a load transmitting member that is formed from a single wire material and includes:

at least one contacting portion that contacts a contactable surface formed in the fuel injection valve;

at least one depressible portion that is depressible in the minus z-direction by a pressing surface formed in the fuel supply conduit; and at least one spring portion that is formed between one end of the at least one contacting portion and the at least one depressible portion and is resiliently deformable by a load, which is applied in the minus z-direction and is received by the at least one depressible portion, while the at least one spring portion transmits the load applied in the minus z-direction to the at least one contacting portion, wherein the load transmitting member is operable to transmit the load, which is received from the fuel supply conduit, to the fuel injection valve; and a fitting member that is formed separately from the load transmitting member and is connected to the load transmitting member on an opposite side of the at least one contacting portion, which is opposite from the at least one spring portion, wherein the fitting member is fittable to the fittable portion of the fuel supply conduit.

2. The clip for the fuel injection valve according to claim 1, wherein:

the at least one contacting portion of the load transmitting member includes two contacting portions that are formed on one side and another side, respectively, of the imaginary axis; and the load transmitting member further includes a connecting portion that connects between the two contacting portions on the opposite side that is opposite from the at least one spring portion.

3. The clip for the fuel injection valve according to claim 1, wherein the fitting member is connected to the load transmitting member such that the fitting member is movable relative to the load transmitting member within a predetermined range.

4. The clip for the fuel injection valve according to claim 1, wherein the fitting member is connected to the load transmitting member such that movement of the fitting member relative to the load transmitting member is limited.

5. The clip for the fuel injection valve according to claim 3, wherein the fitting member is attachably and detachably connected to the load transmitting member.

6. A fuel injection valve unit comprising:

the clip for the fuel injection valve of claim 1; and the fuel injection valve, to which the clip is installed, wherein:

a fuel injection valve side engaging portion, to which a clip side engaging portion formed in the fitting member is engageable, is formed in an outer surface of the fuel injection valve that is located on a side where the fitting member is placed.

* * * * *